US006609321B2

(12) United States Patent
Faifer

(10) Patent No.: US 6,609,321 B2
(45) Date of Patent: Aug. 26, 2003

(54) FOREARM HANDGUARD FOR A RIFLE

(75) Inventor: Tuvia Faifer, Mishmar Ha'shiva (IL)

(73) Assignee: First Samco Inc., Southampton, PA (US)

( * ) Notice: Subject to any disclaimer, the term of this patent is extended or adjusted under 35 U.S.C. 154(b) by 0 days.

(21) Appl. No.: 10/245,057

(22) Filed: Sep. 16, 2002

(65) Prior Publication Data

US 2003/0074822 A1 Apr. 24, 2003

(51) Int. Cl.[7] ..... F41G 1/00
(52) U.S. Cl. ..... 42/71.01; 42/124; 42/143
(58) Field of Search ..... 42/71.01, 72, 75.01, 42/124, 143

(56) References Cited

U.S. PATENT DOCUMENTS

| | | | | | |
|---|---|---|---|---|---|
| 859,932 | A | * | 7/1907 | Edwards | 42/96 |
| 1,037,486 | A | * | 9/1912 | Johnson | 42/71.01 |
| 2,312,150 | A | * | 2/1943 | Conner | 42/75.01 |
| 2,674,822 | A | * | 4/1954 | Studler | 42/71.01 |
| 2,965,994 | A | | 12/1960 | Sullivan | 42/71 |
| 3,641,691 | A | * | 2/1972 | Ellis et al. | 42/105 |
| 4,536,982 | A | * | 8/1985 | Bredbury et al. | 42/71.01 |
| 4,663,875 | A | | 5/1987 | Tatro | 42/71.01 |
| 5,010,676 | A | * | 4/1991 | Kennedy | 42/71.01 |
| 5,103,714 | A | * | 4/1992 | LaFrance | 89/129.01 |
| 5,198,600 | A | | 3/1993 | E'Nama | 42/90 |
| 5,343,650 | A | * | 9/1994 | Swan | 42/117 |
| 5,590,484 | A | | 1/1997 | Mooney et al. | 42/100 |
| 5,826,363 | A | | 10/1998 | Olson | 42/75.01 |
| 6,134,823 | A | * | 10/2000 | Griffin | 42/105 |
| 6,293,040 | B1 | * | 9/2001 | Luth | 42/75.01 |
| 6,381,895 | B1 | * | 5/2002 | Keeney et al. | 42/124 |

FOREIGN PATENT DOCUMENTS

DE 4009012 A * 9/1991 ..... F41C/23/16

* cited by examiner

*Primary Examiner*—Michael J. Carone
*Assistant Examiner*—Denise J Buckley
(74) *Attorney, Agent, or Firm*—Drinker Biddle & Reath LLP

(57) ABSTRACT

A forearm handgrip for a rifle, comprising a pair of essentially identical semi-oval mating half-grip pieces adapted to mate together to form the grip. The half-grip pieces have an exterior shaped in a generally semi-oval lateral section having curved sides and adapted to fit a shooter' hand, and are formed of injection-molded high density polymer. At least the bottom, and preferably both, half-grip piece have an accessory mounting rail recessed in the area at the center of the piece such that the posts and guide channel of the rail are inside what would be the extended arc of the sides of the half grip piece. A cover plate is adapted for engagement with each rail to cover the rail when the rail is not in use, the cover plate being shaped to replicate the extended arc of the sides of the half grip up to a flat longitudinally extending rib running along the center of the cover plate. Ventilation holes may be located in a row in the accessory rail and in the cover plate.

12 Claims, 4 Drawing Sheets

FOREARM HANDGUARD FOR A RIFLE

RELATED PATENTS—CLAIM OF FOREIGN PRIORITY

This application claims the priority of Israel Design Patent Application No. 35626, filed Sep. 16, 2001, titled "HAND GUARD FOR A SHORT M-16 RIFLE INCLUDING A PICATTINI RAIL FOR MOUNTING ACCESSORIES AND A COVER THEREFOR".

1. Field of the Invention

This invention is related to the general field of forearm handguards for firearms, and to the particular field of forearm handguards for high rate of fire tactical rifles and carbines such as the M-16/AR-15 family.

2. Background

Tactical shoulder rifles enable rapid high-volume fire that can heat the rifle barrel to very high temperatures. To protect the rifleman against contact with the hot surface, and to help dissipate the heat, the barrel is usually shrouded by a handguard that completely encloses the portion of the barrel directly in front of the receiver over a length sufficient to provide a grip area for the rifleman's lead hand. This type of forearm handguard is usually "free-floating", i.e. connected to the rifle only at end-cap fittings and not directly in contact with the barrel. The handguard thus creates an air space around the barrel to retard heat conduction from the barrel into the handguard. The handguard is vented with air holes or slots to allow heat convection out of the enclosed air space. An early example of this type handguard is described in U.S. Pat. No. 2,965,994. The handguard described in this reference has a laminated construction, comprising a fiberglass-reinforced plastic outer skin laminated to a low-density foam core, with the inner surface covered by a reflecting foil.

Forearm handguards can have a generally triangular or pear-like sectional shape wherein the base is wider and more flat than the top, as in the earlier versions of M-16. This configuration provides a wider support area for the palm when firing offhand, and a more stable platform when firing over a rest, than would a handguard with a narrow bottom. However, there are advantages to a generally cylindrical handguard wherein the top and bottom pieces are identical mating semi-oval half-pieces, such as described in U.S. Pat. Nos. 4,536,982 and 4,663,875. In such handguards, the area at the center of the half pieces (top and bottom of the assembled handguard) is a flat longitudinal rib with a row of vent holes. The exterior of the top and bottom half-pieces described in U.S. Pat. No. 4,536,982 have laterally extending ribs over most of the surface to enhance structural integrity and provide a firm grip, while the flat longitudinal rib has small longitudinal grooves, perhaps to improve the rest characteristic.

It is also known to attach one or more rail adapters to or along a forearm handguard to mount various accessories to the rifle, as described in U.S. Pat. Nos. 5,826,363; 5,590,484 and 5,198,600. When an adapter rail is not being used, it can be protected by covering it with a panel that slides along the grooves at the sides of the rail, as shown in the above U.S. Pat. No. 5,526,363.

An object of the present invention is to provide a lightweight and easily assembled forearm handguard combining several features shown in the above references, with improvements in how the features are interrelated. In particular, the handgrip is made of two injection-molded plastic half-grip pieces, at least one of which has an integrally-molded accessory rail that it is recessed in the area at the center of the half-grip piece. This recessed positioning locates the ribs and guide channel of the rail inside what would be the extended arc of the sides of the half-grip piece in the traditional handguard of this type. A rail cover is provided that replicates the extended arc of the sides of the half-grip piece up to a flat longitudinally extending rib along the center of the cover. Thus, with the cover installed, the grip has essentially the same feel and dimensions as the traditional oval grip as described and shown in U.S. Pat. Nos. 4,536,982 and 4,663,875. Vent holes may be positioned between the opposing ribs of the rail, and the cover may have matching vent holes in registry with the holes between the rails. The half-pieces and rail covers are preferably injection molded in high-density polymer material.

BRIEF SUMMARY OF THE INVENTION

The forearm handguard is made of two half-grip pieces, each half-grip piece being an integral unit that is injection-molded in high-density polymer material. Each half-grip piece is adapted to mate with another half-grip piece to form a top and a bottom of the handguard. Preferably, the half-grip pieces are identical to each other. The two half-grip pieces assemble together to form a handgrip that encloses an air space surrounding a section of the rifle barrel between the receiver and the front-sight/gas return tube assembly.

At least the bottom half-grip piece (both, if they are identical) has an exterior shaped as a generally semi-oval section, curved at the longitudinal sides and having an accessory mounting rail formed in its longitudinal center (corresponding to the bottom of the assembled handguard). The mounting rail has two rows of opposing posts and a guide channel running along and depending under each row (rails of the type are often identified as "Picatinny Rails", although the invention could be used with other rail systems such as the Weaver Rail). The accessory rail is recessed in the area at the center of the half-grip piece. This recessed positioning locates the posts and guide channel of the rail under what would be the extended arc of the sides of the half grip piece. Ventilation holes to the enclosed air space are located in a row in the accessory rail between the opposing post rows.

The rail is open at the front end to allow an accessory to slide onto the guide channels of the rail in the conventional manner, but terminates at the rear end against a raised flat stop with small longitudinal grooves. A preferred type of cover plate for the rail is injection molded of the same plastic material as the half-grip, and has a pair of a rail-engaging flanges that slide along the guide channels of the rail. The flanges may have a flexible rear section with a hook or detent to snap into a depression or latch in the guide channels when the cover is flush to the raised stop. Alternatively, the cover could be made of natural or synthetic rubber and be stretched over the ribs and snap into the guide channels.

The rail cover is formed to replicate the extended arc of the sides of the half-grip up to a flat rib running longitudinally along the center of the cover. The longitudinal sides of the half-grip piece may have laterally extending ribs to provide a grip surface. The cover plate may then have matching lateral ribs at its sides up to the flat rib. A flat raised stop at the rear of the half grip may have matching small longitudinal grooves to complete the feel of the flat rib when cover is installed. The cover plate has ventilation holes in the flat rib that are in registration with the holes between the rail posts in the half piece when the cover is flush to the raised stop.

The half-grip pieces may also be provided with an array of pins or tabs in the interior cavity for the purpose of attaching a metal heat shield to spread the heat evenly over the interior air space. The mounting rings at the front and rear may have a center slot for the gas return tube, and the sides of the rings may extend short of the sides of the half piece, creating a similar slot at the sides to allow the handgrip to be rotated at 90 degree increments around the barrel.

DESCRIPTION OF THE PREFERRED EMBODIMENTS

Figure 1:
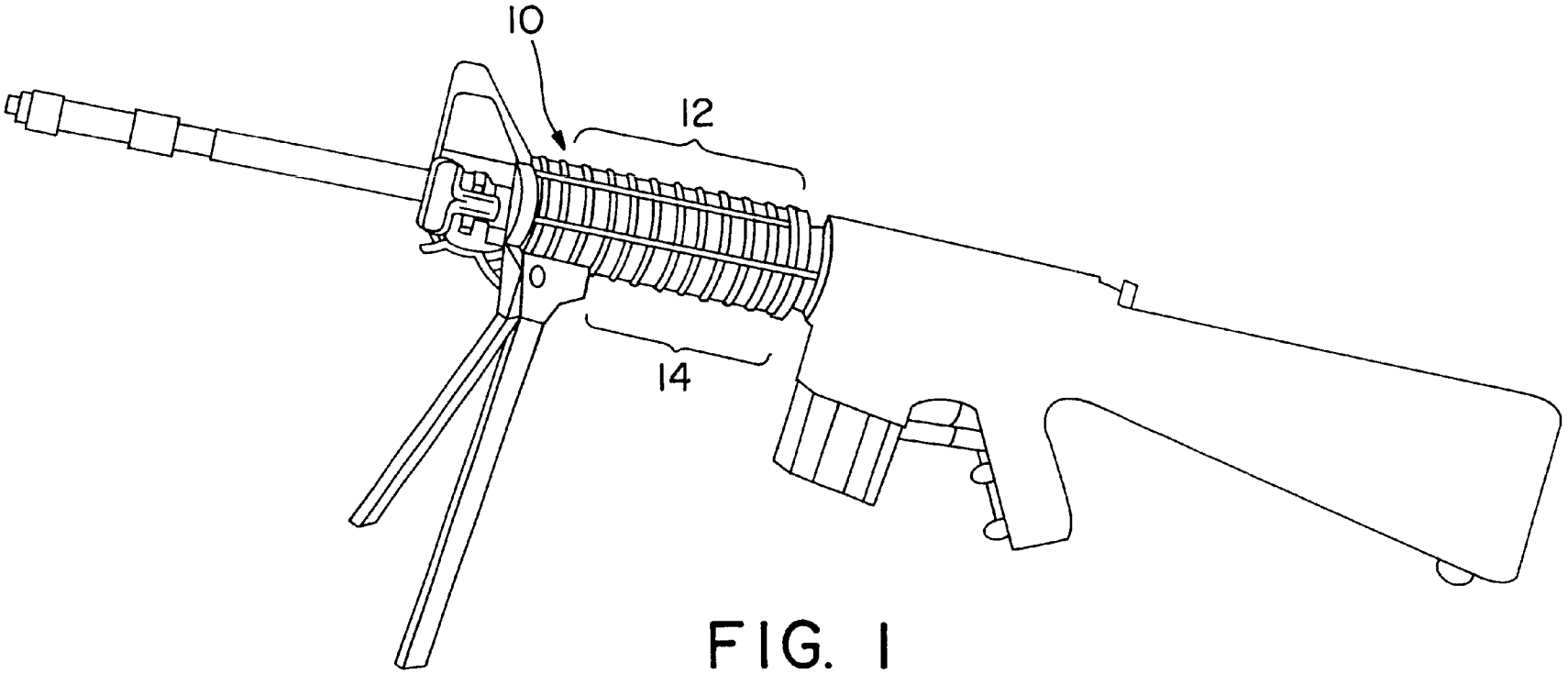
FIG. 1 shows an M-16/AR-15 short-barreled rifle, having a forearm guard of the present invention with a bipod attached to the accessory rail.

In FIG. 1, a short-barreled rifle of the M-16/AR-15 family is equipped with a forearm handguard (10) of the present invention with a bipod attached to an accessory rail. The forearm handguard is made of two half-grip pieces, shown as top half-grip piece (12) and bottom half piece (14). At least the bottom half-grip piece has the accessory rail, as described below.

Figure 2:
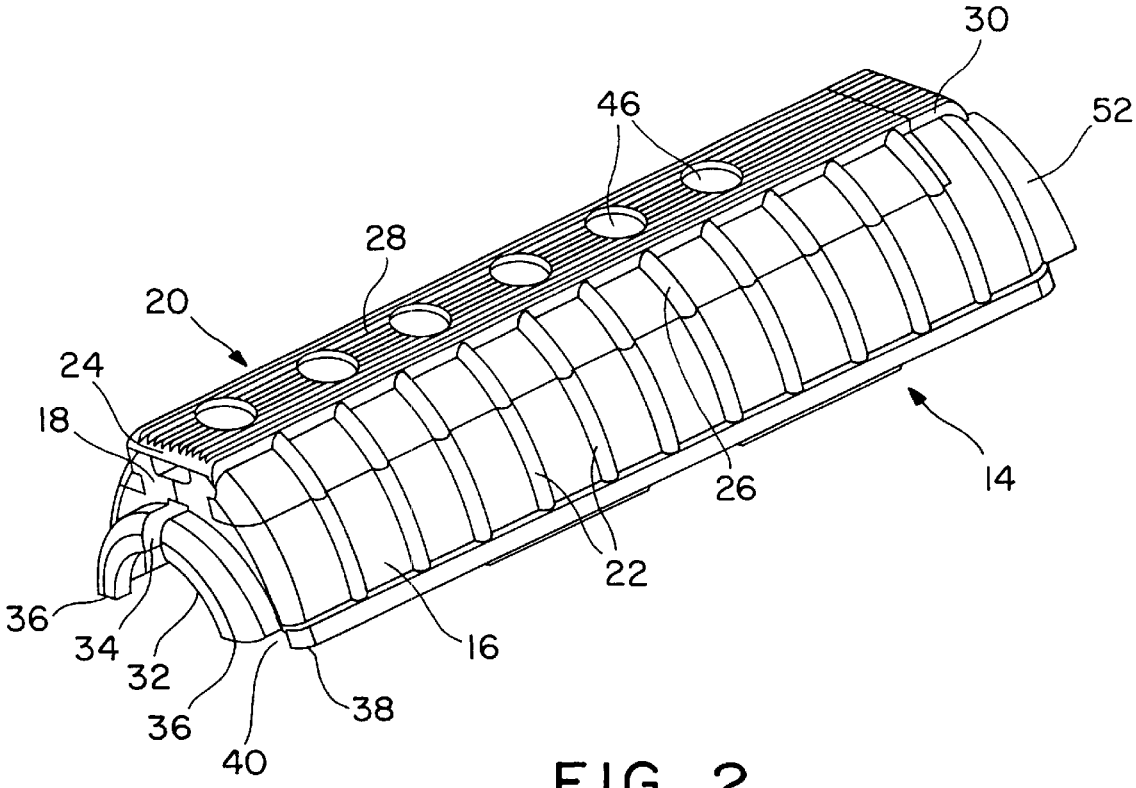
FIG. 2 is a perspective view of the side and front of the exterior of a half-grip piece according to the invention with rail cover installed over the accessory rail.

Preferably, however, the top and bottom pieces are identical. FIG. 2 is a perspective view of the side and front of the exterior of the bottom half-grip piece (14). The top half-grip piece (12) may be identical. The half-grip piece (14) has an exterior that is shaped generally as a semi-oval section, curved at the sides (16) and having an accessory mounting rail (18) formed in its lateral center, which would locate the rail at the bottom of the assembled handguard, as shown in FIG. 1. The rail (18) is covered when not in use by a slidable cover plate (20). The sides (16) of the half piece may have laterally extending ribs (22) to provide a grip surface. The rail cover plate (20) is formed to replicates the extended arc of the sides (16) of the half grip up to a flat longitudinal rib (24) with shallow longitudinal grooves (28) running along the center of the cover plate. The cover plate may have matching lateral ribs (26) at its sides running up to the longitudinal rib. A raised stop (30) for the cover plate extends upward from the rear of the half-grip (14) and may have small longitudinal grooves matching the grooves (28) to complete the feel of the flat longitudinal rib extending the length of the half-grip piece when the cover plate is installed.

A semi-circular mounting ring (32) extends from the front end of the half-grip. This is a conventional ring extension to engage against the rifle's handguard cap (not depicted), except that the ring has a center slot (34) for the rifle's gas return tube, and the ends (36) of the ring extend short of the sides (38) of the half piece, creating similar slots (40) at the front sides of the handguard. Thus, there are slots for the gas return tube at 90 degree intervals, allowing the handguard to be rotated in 90 degree increments around the barrel to place any accessory on the rail in a different orientation.

Figure 3:
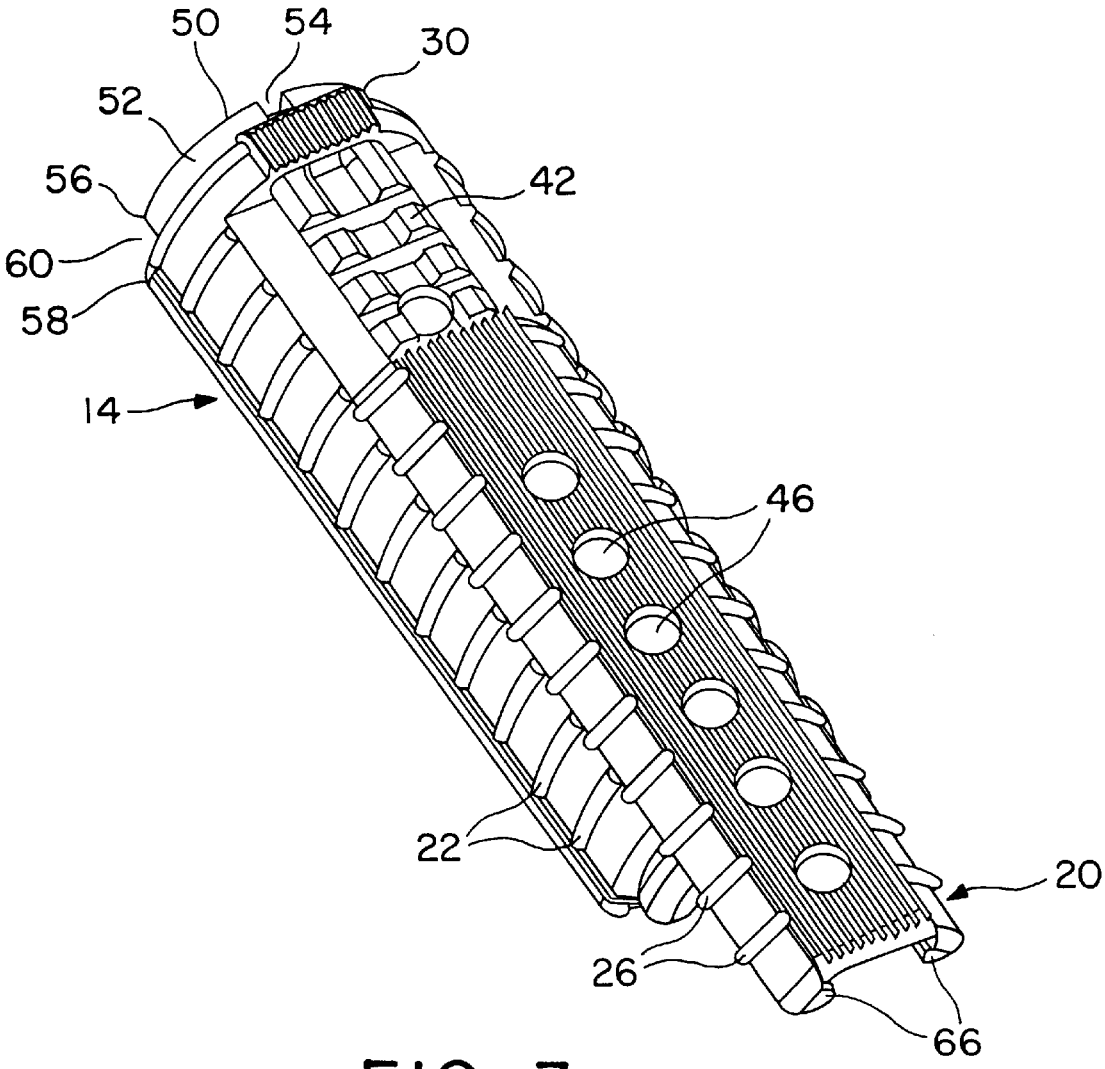
FIG. 3 is a view similar to FIG. 2 of a half-grip piece according to the invention with rail cover slide partially off of the accessory rail.
Figure 4:
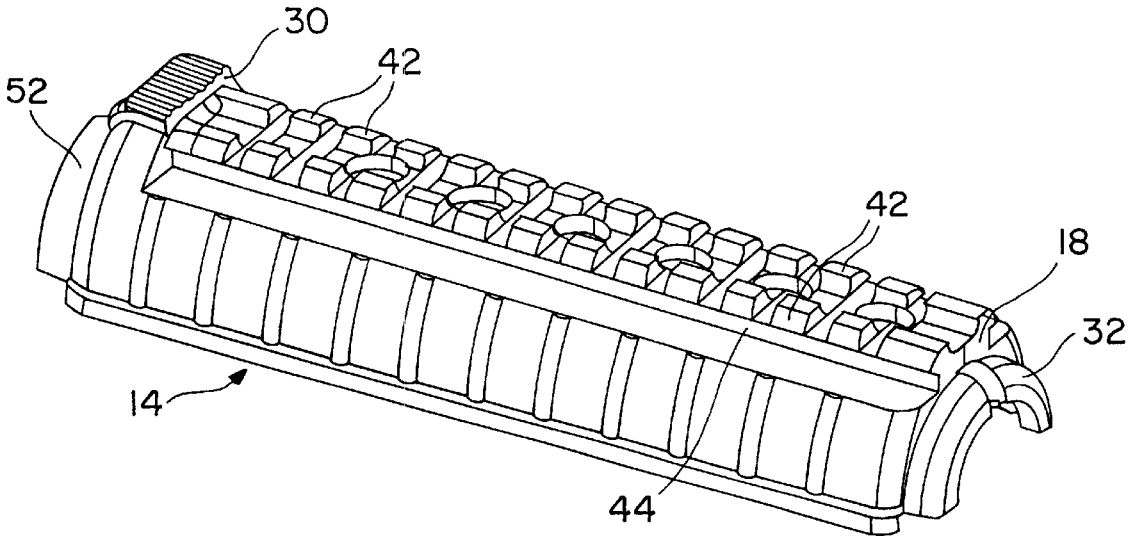
FIG. 4 is a view similar to FIG. 2 of a half-grip piece according to the invention with the accessory rail uncovered.

The accessory mounting rail (18) is better seen in FIGS. 2 and 3. It has two rows of opposing posts (42) and a guide channel (44) along and depending under each row. Rails of this type are well known and often identified as Picatinny Rails. Another common accessory rail is the Weaver Rail. The accessory rail (18) is recessed into the area at the center of the half-grip piece (14), rather than extending outwardly below the piece. This recessed positioning locates the posts (42) and guide channels (44) of the rail inside what would be the extended arc of the sides of the half grip piece if the sides were extended in the manner of the traditional grip of this type. This relationship can be seen by the lateral ribs (26) at the sides of the cover plate matching the arc that the lateral ribs (22) of the half-grip would extend through on the traditional grip.

Ventilation holes (46) are located inside the accessory rail between the opposing post rows. Corresponding ventilation holes (48) are located in the cover plate. The holes are in registry with each other when the cover is in place.

Similar to the front end of the half-grip piece, a semi-circular mounting ring (50) extends from the rear end of the half-grip, as shown in FIG. 3. This is a conventional extension to engage against the rifle's Delta ring (not depicted), except that the ring (50) has a center slot (52) for the rifle's gas return tube, and the ends (54) of the ring extend short of the sides (58) of the half piece, creating similar slots (60) at the rear sides of the handguard. Again, there are slots for the gas return tube at 90 degree intervals, allowing the handguard to be rotated in 90 degree increments around the barrel to place any accessory on the rail in a different orientation.

Figure 5:
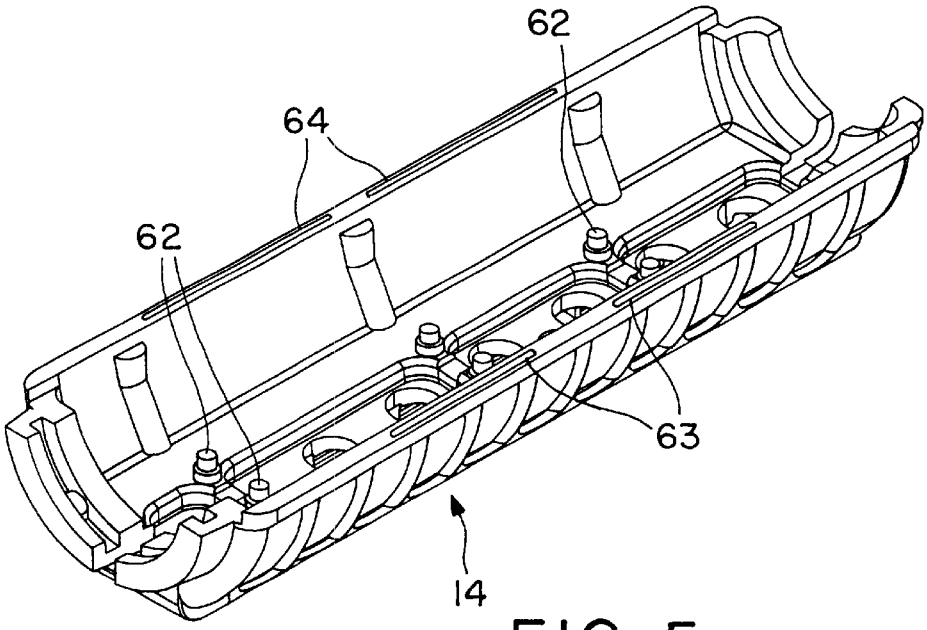
FIG. 5 is a perspective view of the side and front of the interior of the half grip of FIG. 2.

Referring now to FIG. 5, the interior of the half-grip piece (14) may have mounting posts (62) for a metal heat shield (not depicted). The use of heat shields inside forearm handguards is well known and various configurations of shield could be used. The posts (62) provide attachment points for the heat shield, which can have holes formed in it of conforming diameter, by press fitting the shield such that the posts (62) push through the holes in the shield.

Each half-grip piece (12, 14) is preferably an integral unit injection-molded of high-density polymer material. Preferably, the half-grip pieces are identical. The mating of identical half-grip pieces may be accomplished by a pair of lateral ridges (63) in one side edge and a pair of mating slots (64) in the opposite side edge.

A preferred type of cover plate (20) for the rail is injection molded of the same plastic material as the half-grip piece, and has a pair of a rail-engaging flanges (66), as shown in FIG. 3, that slide along the guide channels (44) of the rail. The flanges (66) may have a flexible rear section with a detent (not depicted) to snap into a depression or latch (not depicted) in the guide channels when the cover is flush to the raised rear stop (30). However, an alternative cover could be made of natural or synthetic rubber and be stretched over the rail posts (42) and snap into the guide channels (44). Additionally, the handguard may have permanent rail covers of the preferred slide-on type described above, and replaceable rubber covers. The rubber covers can be used when an accessory is mounted on the rail, and cut to length to cover the portions of the rail that are not covered by the accessory.

I claim:

1. A forearm handgrip for a rifle, the handgrip comprising:

(a) first and second mating half-grip pieces, each half-grip piece defining an elongated body having an exterior shaped in a generally semi-oval lateral section having curved sides and adapted to fit a shooter's hand and a generally hollow interior, the half-grip pieces being adapted to mate together to form a forearm handgrip enclosing an air space surrounding a portion of the rifle barrel;

(b) each half-grip piece being an injection-molded high density polymer body;

(c) at least the first half-grip piece having a longitudinally extending accessory mounting rail formed in the lateral center thereof and recessed in the half-grip piece such that the rail is located inside an extended arc of the sides of the half-grip piece;

(d) a cover plate adapted for engagement with the rail to cover the rail when the rail is not in use, the cover plate being shaped to replicate the extended arc of the sides of the half-grip piece up to a flat longitudinally extending rib running along the center of the cover plate.

2. A forearm handgrip as in claim 1, wherein the cover plate is also formed of injection-molded high-density polymer.

3. A forearm handgrip as in claim 2, further comprising the first half-grip piece having a plurality of ventilation holes spaced in a row within the accessory rail, and the cover plate having matching ventilation holes in registration with the holes in the first half-grip piece when the cover is installed over the rail.

4. A forearm handgrip as in claim 2, further comprising the second half-grip piece being essentially identical to the first half-grip piece.

5. A forearm handgrip as in claim 3, further comprising the second half-grip piece being essentially identical to the first half-grip piece.

6. A forearm handgrip as in claim 1, further comprising the accessory mounting rail having two rows of opposing ribs and a guide channel along and depending under each row, and the cover plate having a pair of a rail-engaging flanges that slide along the guide channels of the rail.

7. A forearm as in claim 6, further comprising the accessory mounting rail being open at its front end to allow an accessory to slide onto the guide channels, and the rail terminating at a rear end against a generally flat stop extending upward from the half-grip piece, the stop having the shape of an extension of the flat longitudinally extending rib of the cover plate.

8. A forearm handgrip as in claim 6, further comprising the flanges have a flexible rear section with a detent to engage with the guide channels when the cover is installed.

9. A forearm handgrip as in claim 7, further comprising the second half-piece being essentially identical to the first half-piece.

10. A forearm handgrip for a rifle, the handgrip comprising:

(a) a pair of essentially identical mating half-grip pieces, each half-grip piece defining an elongated body having an exterior shaped in a generally semi-oval lateral section having curved sides and adapted to fit a shooter's hand and a generally hollow interior, the half-grip pieces being adapted to mate together to form a forearm handgrip enclosing an air space surrounding a portion of the rifle barrel;

(b) each half-grip piece being an injection-molded high density polymer body;

(c) each half-grip piece having a longitudinally extending accessory mounting rail formed in the lateral center thereof and recessed in the half-grip piece such that the rail is located inside an extended arc of the sides of the half-grip piece;

(d) for each accessory mounting rail, a cover plate injection molded of high density polymer and adapted for slideable engagement with the rail to cover the rail when the rail is not in use, the cover plate being shaped to replicate the extended arc of the sides of the half grip up to a flat longitudinally extending rib running along the center of the cover plate.

11. A forearm handgrip as in claim 10, further comprising each accessory mounting rail having two rows of opposing ribs and a guide channel along and depending under each row, and each cover plate having a pair of a rail-engaging flanges that slide along the guide channels of a respective rail.

12. A forearm handgrip as in claim 11, further comprising each accessory mounting rail being open at its front end to allow an accessory to slide onto the guide channels, and each rail terminating at a rear end against a generally flat stop extending upward from the respective half-grip piece, the stop having the shape of an extension of the flat longitudinally extending rib of the cover plate.

* * * * *